US006661177B2

(12) United States Patent
Luijks et al.

(10) Patent No.: US 6,661,177 B2
(45) Date of Patent: Dec. 9, 2003

(54) HIGH-PRESSURE DISCHARGE LAMP WITH IGNITION CIRCUIT INCLUDING HALOGEN INCANDESCENT LAMP

(75) Inventors: Gerardus Marinus Josephus Franciscus Luijks, Eindhoven (NL); Johan Leopold Victorina Hendrix, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/923,606

(22) Filed: Aug. 7, 2001

(65) Prior Publication Data

US 2002/0047529 A1 Apr. 25, 2002

(30) Foreign Application Priority Data

Aug. 8, 2000 (EP) ..... 00202800

(51) Int. Cl.[7] ..... H01J 13/46; H01K 7/00

(52) U.S. Cl. ..... 315/60; 315/59; 315/71; 313/316; 313/315; 313/578; 313/579; 313/569

(58) Field of Search ..... 315/60, 58, 59, 315/71, 50, 52, 53; 313/569, 578, 25, 315, 316, 579

(56) References Cited

U.S. PATENT DOCUMENTS

| | | | | | |
|---|---|---|---|---|---|
| 3,048,741 | A | | 8/1962 | Thouret | 315/49 |
| 4,268,780 | A | * | 5/1981 | Roche et al. | 315/100 |
| 4,494,041 | A | * | 1/1985 | Roche et al. | 315/101 |
| 4,520,294 | A | * | 5/1985 | Iida et al. | 315/290 |
| 5,531,250 | A | | 7/1996 | Freeman et al. | 138/94 |
| 5,973,453 | A | | 10/1999 | Van Vliet et al. | 313/623 |
| 6,392,343 | B1 | * | 5/2002 | Luijks et al. | 313/25 |
| 6,404,128 | B1 | * | 6/2002 | Kroes | 313/567 |

FOREIGN PATENT DOCUMENTS

| | | | |
|---|---|---|---|
| GB | 1596161 | 8/1981 | H05B/41/18 |

* cited by examiner

*Primary Examiner*—Don Wong
*Assistant Examiner*—Tuyet T. Vo
(74) *Attorney, Agent, or Firm*—Ernestine C. Bartlett

(57) ABSTRACT

The invention relates to a high-pressure discharge lamp comprising a discharge vessel which is enclosed, with clearance, by an outer bulb. The outer bulb is closed at one end by a lamp cap. The lamp is provided with an ignition circuit including at least a series arrangement of a glow starter and an ohmic impedance. According to the invention, the ohmic impedance is formed by a halogen incandescent lamp.

4 Claims, 2 Drawing Sheets

HIGH-PRESSURE DISCHARGE LAMP WITH IGNITION CIRCUIT INCLUDING HALOGEN INCANDESCENT LAMP

BACKGROUND OF THE INVENTION

The invention relates to a high-pressure discharge lamp comprising a discharge vessel which is enclosed, with clearance, by an outer bulb which is provided, at an end, with a lamp cap, which lamp also comprises an ignition circuit including a series arrangement of a glow starter switch and an ohmic impedance.

A lamp of the type mentioned in the opening paragraph is disclosed in GB 1596161. An advantageous aspect of a lamp having a built-in ignition circuit resides in that, in principle, said lamp can suitably be used as a retrofit lamp for an apparatus intended for a high-pressure mercury discharge lamp. State-of-the-art high-pressure discharge lamps, such as high-pressure sodium lamps and metal halide lamps, have a very high ignition voltage and, consequently, the ignition circuit must generate a high ignition pulse, for example of at least 2.5 kV. As a result, comparatively large currents occur in the ignition circuit, which currents are limited as much as possible by means of the ohmic impedance. Consequently, however, the ohmic impedance must also be comparatively large, and a substantial degree of dissipation takes place in the ohmic impedance. This is disadvantageous and requires the use of special high-power ohmic impedances, which has a cost-increasing effect and hence is disadvantageous.

OBJECTS AND SUMMARY OF THE INVENTION

It is an object of the invention to provide a means for counteracting said drawbacks. To achieve this, a lamp of the type mentioned in the opening paragraph is characterized, as a lamp in accordance with the invention, in that the ohmic impedance is formed by a halogen incandescent lamp. As an incandescent element, for example in the form of an incandescent filament, of an incandescent lamp is intended to adopt a high temperature and said incandescent element is also incorporated in a halogen-filled bulb, the incandescent lamp is resistant to comparatively prolonged and comparatively substantial dissipation of the incandescent body. Large-scale use of halogen incandescent lamps in a large power range for illumination purposes further has the advantage that there is ample supply of such lamps, so that a person skilled in the art can readily select, at comparatively low costs, a suitable halogen incandescent lamp for use in the ignition circuit of the lamp in accordance with the invention. Surprisingly, it has been found that the halogen incandescent lamp can also serve as a UV-enhancer. A UV-enhancer has a very favorable effect on the speed and reliability with which the high-pressure discharge lamp is ignited. This is favorable for, in particular, metal halide lamps, as their ignition behavior is influenced to a substantial degree by the presence of free electrons. Preferably, such a metal halide lamp is provided with a discharge vessel having a ceramic wall. The lamp thus formed has the advantage that it combines a favorable ignition behavior with very good light-technical properties, such as a high luminous flux and stable color properties.

Preferably, the series arrangement also comprises a bimetal switch, which is closed in the cold state. This has the advantage that the series arrangement can be electrically switched off as soon as the lamp has been ignited, for example under the influence of the heat development resulting from the discharge. A further advantage resides in that, after lamp extinction and re-application of a supply voltage, ignition voltage peaks will not be generated until after the bimetal switch has cooled to such temperature that it is in the closed state. It is thus precluded that the ignition circuit is needlessly loaded.

BRIEF DESCRIPTION OF THE DRAWINGS

These and other aspects of the invention will be apparent from and elucidated with reference to the embodiment(s) described hereinafter.

In the drawings.

DESCRIPTION OF THE PREFERRED EMBODIMENTS

Figure 1:
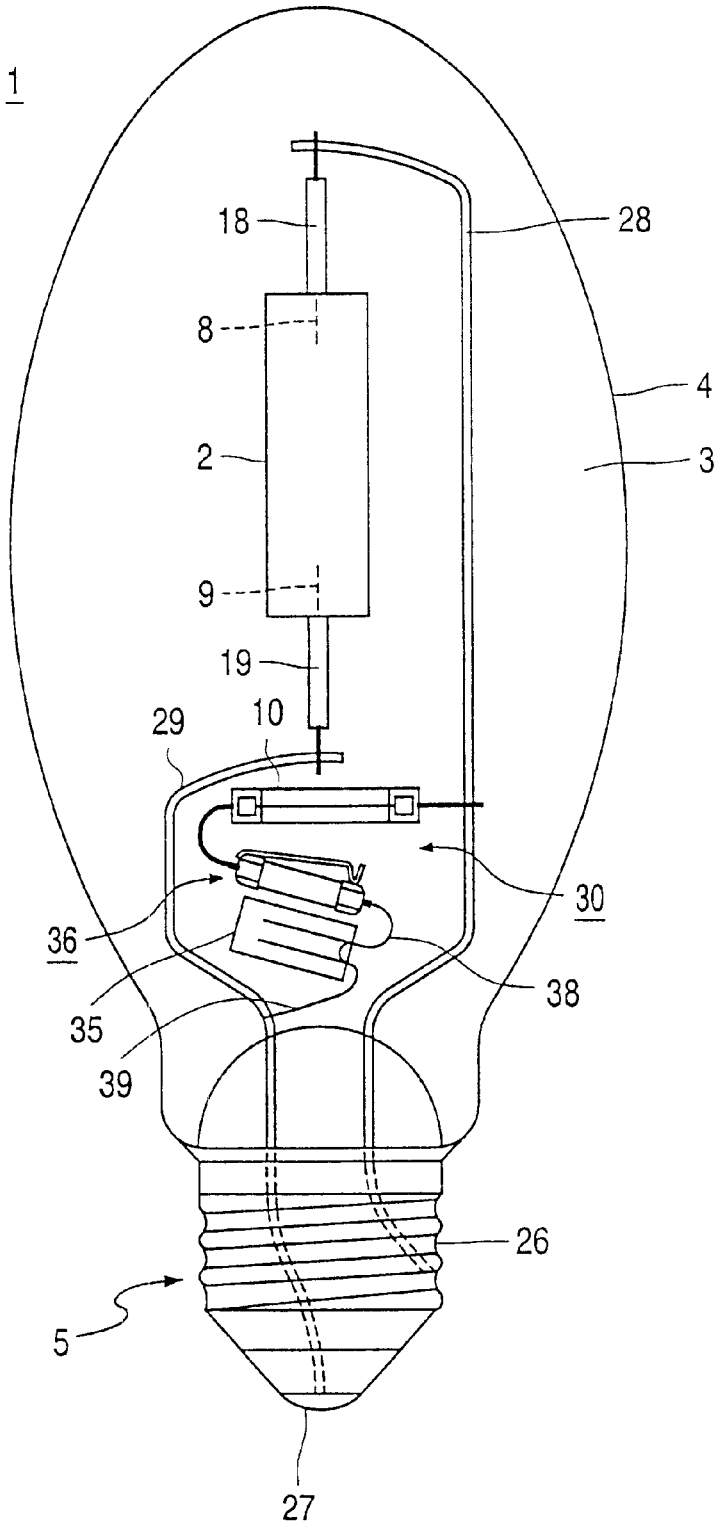
FIG. 1 shows a lamp in accordance with the invention.

FIG. 1 shows a high-pressure discharge lamp 1 comprising a discharge vessel 2 which is enclosed, with clearance 3, by an outer bulb 4, which is provided, at an end, with a lamp cap 5, which lamp also comprises an ignition circuit 30, which includes a series arrangement of a glow starter switch 35, an ohmic impedance 10 in the form of a halogen incandescent lamp and a bimetal switch 36. The sequence of the elements of the series arrangement is arbitrary.

The discharge vessel 2 is provided, on either side, with a projecting plug 18, 19 accommodating a lead-through interconnecting inner electrodes 8, 9 and current supply conductors 28, 29. The current supply conductors are electrically connected to electric contacts 26, 27 of the lamp cap 5.

Figure 2:
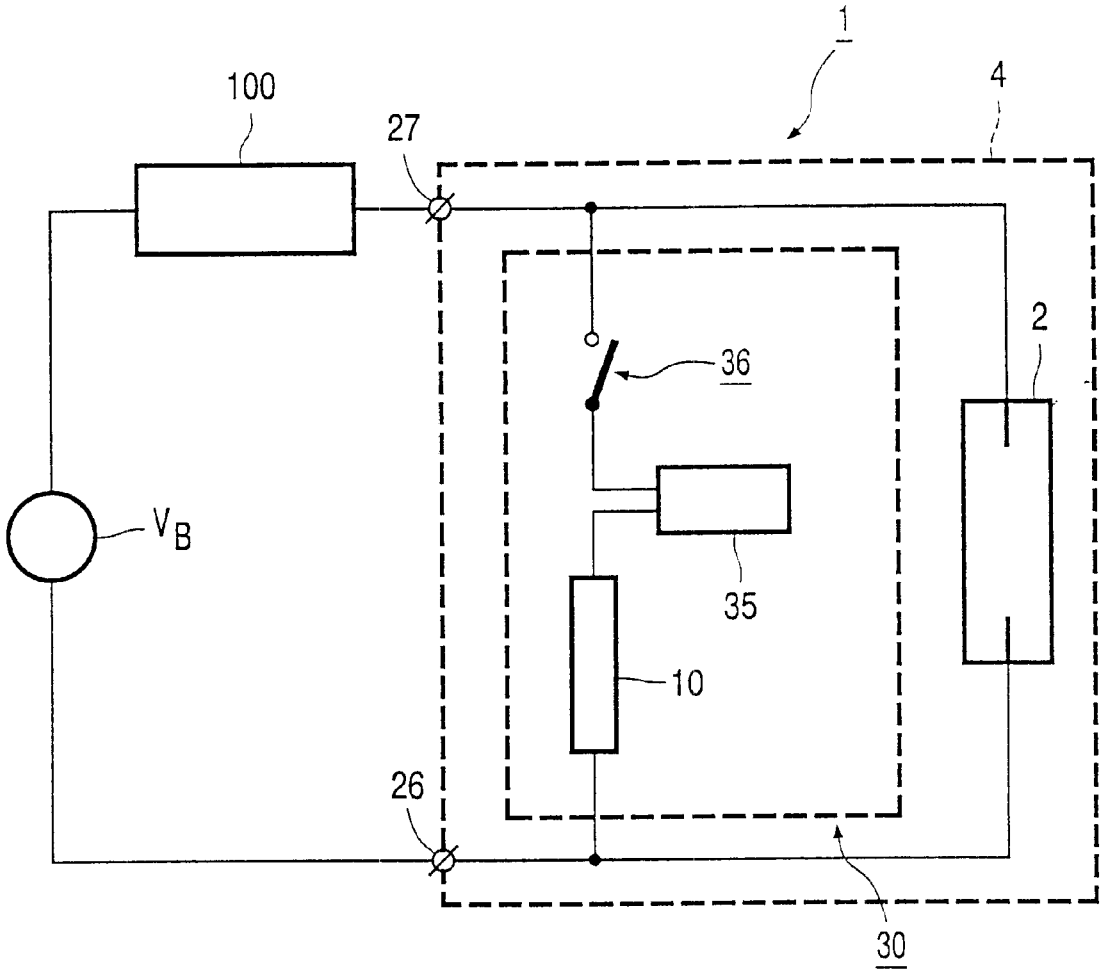
FIG. 2 shows an electrical circuit diagram of the lamp in accordance with FIG. 1.

In FIG. 2, the lamp 1 is connected with the electric contacts 26, 27 to a power supply source VB in a customary manner via a stabilization ballast 100. In a practical embodiment of a lamp in accordance with the invention, the lamp is a high-pressure sodium lamp having a rated power of 400 W. The lamp is connected to a supply source of 220 V, 50 Hz, via a BSN 400L 33-type ballast, manufactured by Philips. In another embodiment, the lamp is a metal halide lamp having a rated power of 400 W. The discharge vessel of the lamp has a ceramic wall. The filling of the discharge vessel includes, apart from Hg and Na, iodides of Tl, Dy, Ca, Ho and Tm and Xe as the starting gas. A supply source can suitably be used to operate the lamp via a MH 400 W CWA 71A6091-type ballast. The ballast can be connected to a 60 Hz supply source with a voltage ranging between 120 and 277 V, and supplies a voltage of 135 V to the lamp terminals.

The halogen incandescent lamp which forms part of the ignition circuit incorporated in the lamp is a 230 V, 150 W halogen-a type lamp, manufactured by Philips. The halogen incandescent lamp is provided with a quartz-glass envelope. As a result, the incandescent lamp is highly heat-resistant. This has the advantage that there is substantial freedom regarding the placement of the halogen incandescent lamp in the outer bulb. The glow starter switch, for example a retrolux-type glow starter, which is known per se, manufactured by Philips, and the bimetal switch may form a compound module.

In practice it is found that during igniting and operating said lamp, the maximum value of the inrush current through the ignition circuit is 5.8 A. The average short-circuit current through the ignition circuit, however, is 0.73 A. In a further practical embodiment, the lamp is a metal halide lamp which can suitably be operated on a MH 175 W CWA 71A5590-type ballast, manufactured by Advance Transformer. The incandescent lamp forming part of the ignition circuit is of the same type as that used in the preceding example. In this further example, the maximum current through the series arrangement is 4 A, and the average short-circuit current through the ignition circuit is 0.69 A.

In both practical embodiments, the generated ignition pulse exceeds 2.5 kV, and the temperature of the glow starter switch is below 250° C. The ignition circuit described herein was also subjected to a switching life test, wherein the supply voltage was alternately switched on for 5 s and switched off for 35 s. After 2000 switching operations, the generated ignition pulse is still >3 kV. In another test, the lamp was ignited in a dark environment and after a long residence time in a dark environment. In this test, no appreciable ignition delay occurred.

What is claimed is:

1. A high-pressure discharge lamp comprising a discharge vessel which is enclosed, with clearance, by an outer bulb which is provided, at an end, with a lamp cap, which lamp also comprises an ignition circuit including a series arrangement of a glow starter switch and an ohmic impedance, characterized in that said ohmic impedance is formed by a halogen incandescent lamp.

2. The high-pressure discharge lamp as claimed in claim 1, characterized in that the lamp is a metal halide lamp.

3. The high-pressure discharge lamp as claimed in claim 1, characterized in that the lamp comprises a discharge vessel with a ceramic wall.

4. The high-pressure discharge lamp as claimed in claim 1, characterized in that the series arrangement also comprises a bimetal switch, which is closed in a cold state.

* * * * *